US011753824B2

(12) United States Patent
Yin et al.

(10) Patent No.: US 11,753,824 B2
(45) Date of Patent: Sep. 12, 2023

(54) REBAR CAGE

(71) Applicant: RUENTEX ENGINEERING & CONSTRUCTION CO., LTD., Taipei (TW)

(72) Inventors: Samuel Yin, Taipei (TW); Jui-Chen Wang, Taipei (TW); Chang Yen Wei, Taipei (TW); Jhih-Syuan Chen, Taipei (TW)

(73) Assignee: RUENTEX ENGINEERING & CONSTRUCTION CO., LTD., Taipei (TW)

( * ) Notice: Subject to any disclaimer, the term of this patent is extended or adjusted under 35 U.S.C. 154(b) by 0 days.

(21) Appl. No.: 17/676,047

(22) Filed: Feb. 18, 2022

(65) Prior Publication Data

US 2022/0268024 A1 Aug. 25, 2022

(30) Foreign Application Priority Data

Feb. 24, 2021 (TW) ..... 110106446

(51) Int. Cl.
*E04C 5/06* (2006.01)

(52) U.S. Cl.
CPC ..... *E04C 5/0622* (2013.01)

(58) Field of Classification Search
CPC ..... E04C 5/06; E04C 5/0604; E04C 5/0609; E04C 5/0622
See application file for complete search history.

(56) References Cited

U.S. PATENT DOCUMENTS 3,744,207 A * 7/1973 Oroschakoff ..... B21F 27/121 52/649.3
3,778,951 A * 12/1973 Oroschakoff ..... E04C 5/0609 52/646
2019/0078314 A1* 3/2019 Yin ..... E04B 5/48

FOREIGN PATENT DOCUMENTS

AT 320937 B * 3/1975
DE 102006059365 A1 * 6/2007
WO WO-0126974 A2 * 4/2001
WO WO-2006075044 A1 * 7/2006

* cited by examiner

*Primary Examiner* — Christine T Cajilig
(74) *Attorney, Agent, or Firm* — Juan Carlos A. Marquez; Marquez IP Law Office, PLLC

(57) ABSTRACT

A rebar cage is provided, which includes a continuous stirrup having two opposite lateral sections and a middle section located therebetween. The continuous stirrup includes a plurality of first portions extending along a Z-axis direction and located in the two lateral sections, a plurality of second portions connecting the tops of two adjacent first portions along an X-axis direction, and a plurality of third portions located in the middle region and each connecting the bottoms of two of the first portions along a Y-axis direction wherein a plurality of longitudinal tie bars extend along the X-axis direction and are connected to the first portions.

7 Claims, 13 Drawing Sheets

REBAR CAGE

FIELD OF THE INVENTION

The instant disclosure relates to a rebar cage, in particular to a rebar cage used in a beam structure.

BACKGROUND

A rebar cage used in construction, such as a rebar cage used in a beam structure, is usually provided with stirrups for holding in place rebars and resisting shear caused by tension. In a conventional rebar cage for a beam structure, U-shaped stirrups are welded or tied to longitudinal rebars. However, it is labor-consuming and time-consuming to weld or tie each of the U-shaped stirrups to longitudinal rebars. In addition, the two free ends of each of the U-shaped stirrups are sharp and may cause injuries to personnel nearby, such as a worker. Therefore, it is necessary to provide sheaths or the like on the free ends of the U-shaped stirrups to prevent workers from being wounded by the sharp free ends. Such sheaths incur additional costs and may need to be disposed of once they are worn out.

Therefore, it is desirable to provide a rebar cage that is safe and can save time and cost in manufacturing the same.

SUMMARY OF THE INVENTION

According to one exemplary embodiment of the instant disclosure, a rebar cage is provided. The rebar cage comprises a continuous stirrup and a plurality of longitudinal tie bars. The continuous stirrup is defined as a first lateral section, a second lateral section and a middle section located between the first lateral section and the second lateral section, wherein the first lateral section and the second lateral section are located at opposing sides of the middle section, generally parallel to each other, and generally perpendicular to the middle section. The continuous stirrup comprises a plurality of first portions, a plurality of second portions, and a plurality of third portions. The plurality of first portions are disposed along a Z-axis direction and located in the first lateral section and the second lateral section, and are generally parallel to one another. The plurality of second portions are disposed along an X-axis direction and located in the first lateral section and the second lateral section. Each of the plurality of second portions connects top ends of two adjacent first portions. The plurality of third portions are disposed along a Y-axis direction and located in the middle section. Each of the plurality of third portions connects bottom ends of two opposing first portions. The plurality of longitudinal tie bars extend along the X-axis direction and are connected to the first portions of the continuous stirrup.

According to another exemplary embodiment of the instant disclosure, a rebar cage is provided. The rebar cage comprises a continuous stirrup and a plurality of longitudinal tie bars. The continuous stirrup is defined as a first lateral section, a second lateral section and a middle section located between the first lateral section and the second lateral section, wherein the first lateral section and the second lateral section are located at opposing sides of the middle section, generally parallel to each other, and generally perpendicular to the middle section. The continuous stirrup comprises a plurality of first portions, a plurality of first positioning portions, a plurality of second positioning portions, a plurality of second portions, and a plurality of third portions. The plurality of first portions are disposed along a Z-axis direction and located in the first lateral section and the second lateral section and are generally parallel to one another. The plurality of first positioning portions are bent from the top ends of the plurality of first portions located in the first lateral section toward an inner side of the rebar cage. The plurality of second positioning portions are bent from the top ends of the plurality of first portions located in the second lateral section toward the inner side of the rebar cage. The plurality of second portions are disposed along an X-axis direction and connect the tops of two adjacent first positioning portions or two adjacent second positioning portions. The plurality of third portions are disposed along a Y-axis direction and located in the middle section. Each of the plurality of third portions connect bottoms of two opposing first portions. The plurality of longitudinal tie bars extend along the X-axis direction and are connected to the plurality of first portions, the plurality of first positioning portions and/or the plurality of second positioning portions.

The following embodiments are provided along with illustrations to facilitate appreciation of the instant disclosure; however, the appended drawings are merely provided for reference and illustration, not to limit the scope of the instant disclosure.

BRIEF DESCRIPTION OF THE DRAWINGS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

DETAILED DESCRIPTION OF THE PREFERRED EMBODIMENTS

Figure 1:
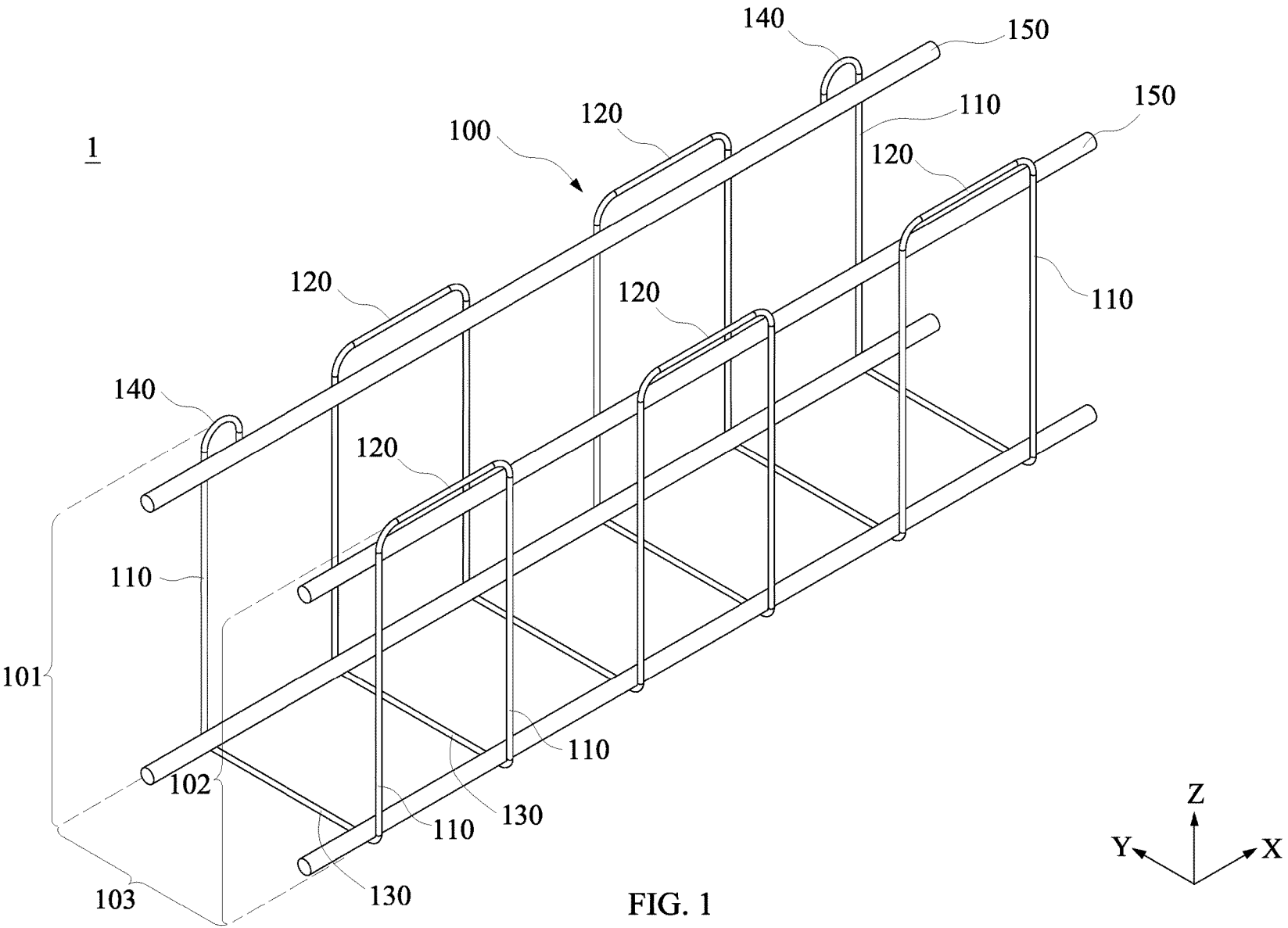
FIG. 1 is a perspective schematic view showing a rebar cage in accordance with an embodiment of the instant disclosure.

In order to facilitate understanding of the technical features, technical contents, technical advantages and technical effects of the subject invention, a detailed description with accompanying drawings is provided below for explanation only. The drawings only serve an auxiliary purpose for understanding of the technical contents; the scope of the subject invention should not be interpreted merely based on the scale or the relative positions between the elements illustrated in the drawings.

The terminology used in the description of the present disclosure herein is for the purpose of describing particular embodiments only, and is not intended to be construed as a limitation of the invention. As used in the description of the invention and the appended claims, the singular articles "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

A coordinate having an-X axis, a Y-axis and a Z-axis is presented in the figures of the present application for describing the structures of the rebar cages of the present disclosure. In one embodiment as shown in FIG. 1, the rebar cage (1), which may be used in a non-weight-bearing beam of a building, comprises a continuous stirrup (100) and a plurality of longitudinal tie bars (150). The continuous stirrup (100) is defined as a first lateral section (101), a second lateral section (102) and a middle section (103) located between the first lateral section (101) and the second lateral section (102), wherein the first lateral section (101) and the second lateral section (102) are located at opposing sides of the middle section (103), generally parallel to each other, and generally perpendicular to the middle section (103).

The continuous stirrup (100) comprises a plurality of first portions (110), a plurality of second portions (120), and a plurality of third portions (130). The plurality of first portions (110) are disposed along a Z-axis direction and located in the first lateral section (101) and the second lateral section (102), and are generally parallel to one another. The plurality of first portions (110) are in two rows and spaced apart from each other when they are viewed in an X-axis direction. The plurality of second portions (120) are disposed along the X-axis direction and located in the first lateral section (101) and the second lateral section (102). Each of the plurality of second portions (120) connects top ends of two adjacent first portions (110). The plurality of third portions (130) are disposed along a Y-axis direction and located in the middle section (103). Each of the plurality of third portions (130) connects bottom ends of two opposing first portions (110). The plurality of longitudinal tie bars (150) extend along the X-axis direction and are connected to the first portions (110) of the continuous stirrup (100).

In the instant embodiment, the plurality of second portions (120) are alternatively disposed along the X-axis direction so that the plurality of second portions (120) are substantively not overlapping in the Y-axis direction. However, in alternative embodiments, the plurality of second portions (120) are substantively overlapped in the Y-axis direction.

As shown in FIG. 1, each of the two free ends of the continuous stirrup (100) comprises a hook (140) and the hook (140) is bent along the X-axis direction. In addition, the two hooks (140) are both located in the first lateral section (101). In alternative embodiments, the two hooks (140) are both located in the second lateral section (102) or the two hooks (140) are arranged so that one of them is in the first lateral section (101) and the other is in the second lateral section (102). The hooks (140) are configured to prevent workers from being wounded. In other embodiments, the two free ends of the continuous stirrup (100) do not have such hooks and the two first portions (110) having the two free ends are shorter than the other first portions (110) so that the free ends, which may be sharp, would not be easily touched by workers.

As shown in FIG. 1, there are four longitudinal tie bars (150) that extend along the X-axis direction of which two longitudinal tie bars (150) are opposingly disposed near the bottom of the rebar cage (1) and are respectively connected to the joints of the plurality of first portions (110) and the plurality of third portions (130), and the other two longitudinal tie bars (150) are opposingly disposed near the top of the rebar cage (1) and are respectively connected to one row of second portions (120) in the first lateral section (101) and the other row of second portions (120) in the second lateral section (102). Furthermore, the joints of the plurality of first portions (110) and the plurality of second portions (120) are rounded to prevent workers from being wounded.

Figure 2:
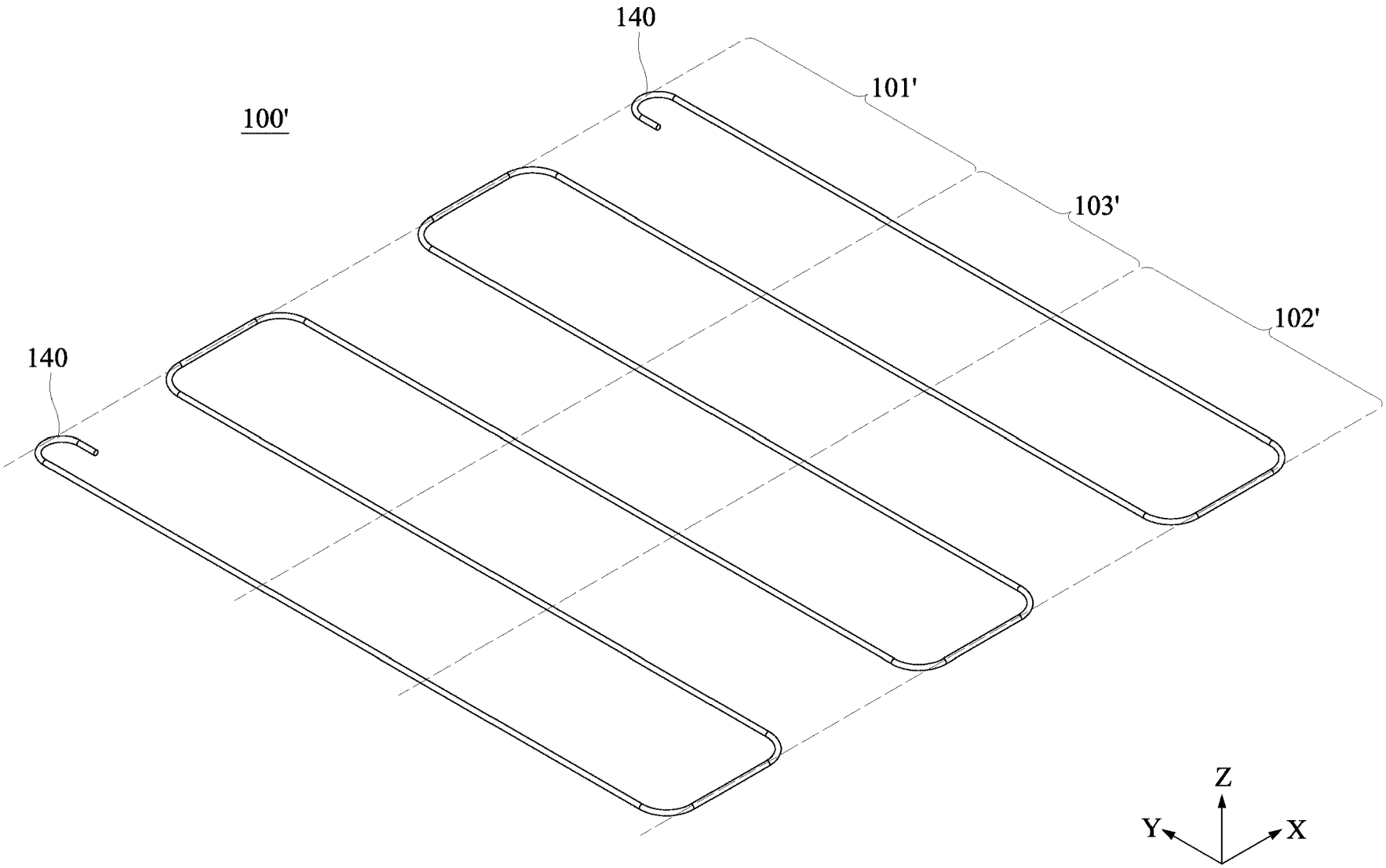
FIG. 2 is a perspective schematic view showing a continuous stirrup for making a rebar cage in accordance with the embodiment of the instant disclosure.
Figure 3:
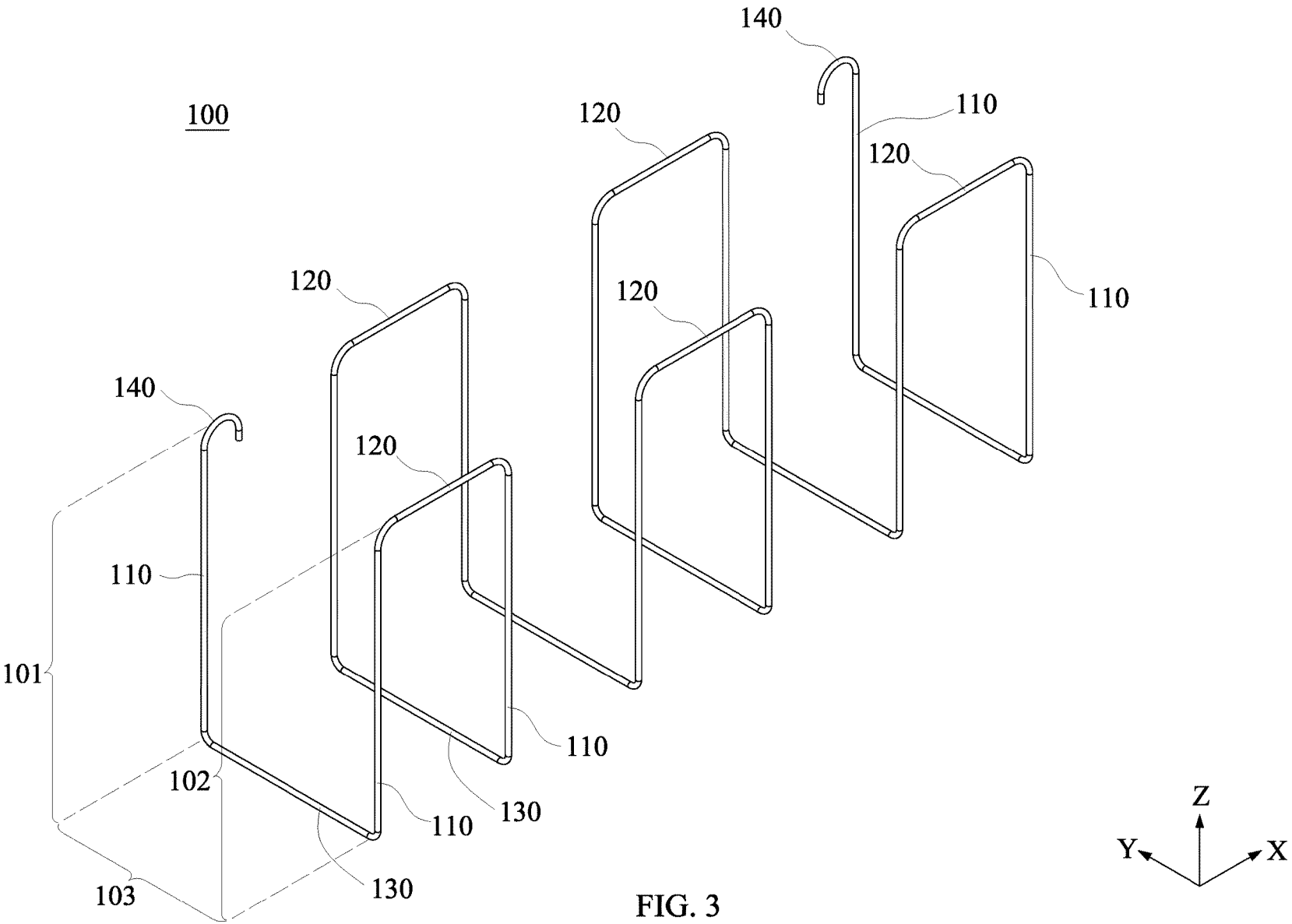
FIG. 3 is a perspective schematic view showing the continuous stirrup after being bent for making a rebar cage in accordance with the embodiment of the instant disclosure.

In some embodiments, the process of making the continuous stirrup (100) shown in FIG. 3 for the rebar cage (1) in FIG. 1 includes the following steps: (A) bending a straight rebar to form a planar structure 100' having alternating rectangular turns and two hooks (140) at its free ends as shown in FIG. 2 wherein the first lateral section (101), the second lateral section (102), and the third lateral section (103) are in the same plane; (B) securing at least a part of the first lateral section (101) and using an elongated device (not shown) to press against the second lateral section (102) and the third lateral section (103) toward the secured first lateral section (101); and (C) securing at least a part of the second lateral section (102) and using the elongated device to press against the first lateral section (101) and the third lateral section (103) toward the secured second lateral section (102) so as to form the continuous stirrup (100) as shown in FIG. 3 wherein the first lateral section (101) and the second lateral section (102) are at opposing sides of the third lateral section (103), generally parallel to each other, and are perpendicular to the third lateral section (103).

Figure 4:
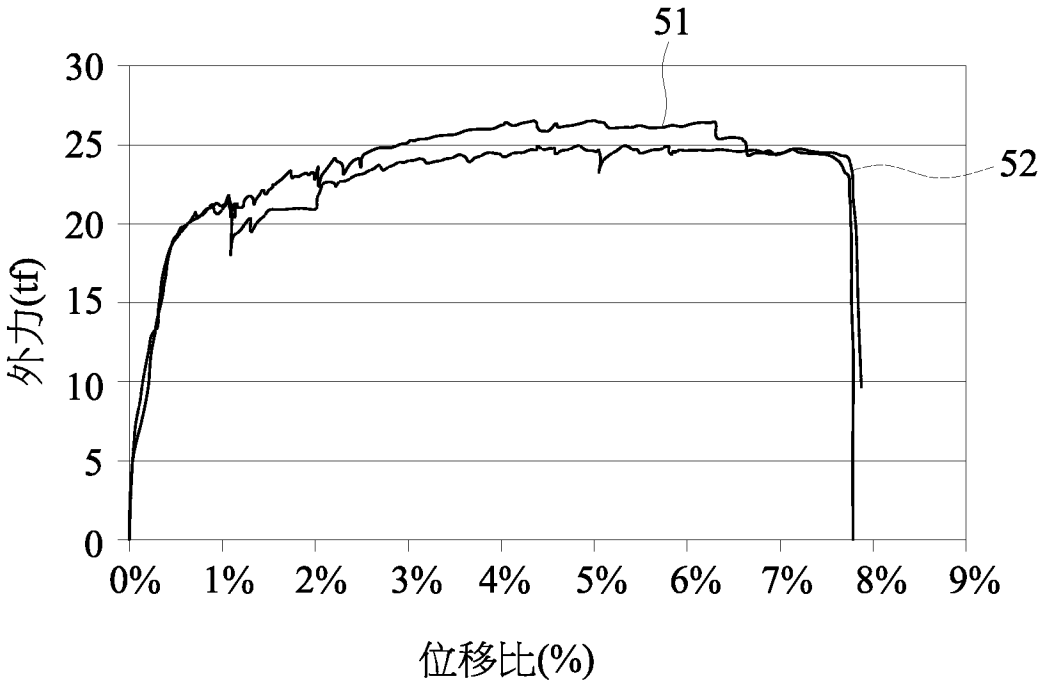
FIG. 4 is a diagram showing the test results based on the embodiment of the instant disclosure and a prior-art rebar cage I.

FIG. 4 is a diagram showing the test results based on the rebar cage (1) and the prior-art rebar cage I as described in the background section of this application, which comprises a number of U-shaped stirrups welded or tied to longitudinal rebars wherein the U-shaped stirrups in the prior-art rebar cage I are spaced apart at a predetermined distance.

As shown in FIG. 4, the line indicated by reference numeral 51 represents the rebar cage (1) of the present disclosure and the line indicated by reference numeral 52 represents the prior-art cage I. In FIG. 4, where the displacement ratio is below 1%, the rebar cage (1) and the prior-art cage I can bear substantially the same load, and where the displacement ratio is equal to or larger than 1%, the rebar cage (1) can bear a load heavier than that which can be borne by the prior-art rebar cage I.

Corresponding to the diagram shown in FIG. 4, below Table 1 shows the relevant test results. According to Table 1, the rebar cage (1) can bear a load of 26.79 tf, which is around 7% higher than the load of 25.03 tf that can be borne by the prior-art rebar cage I. The rebar cage (1) under the load has a maximum displacement ratio of 7.67%, which is around 0.8% lower than the displacement ratio of 7.73% of the prior-art rebar cage I. In addition, the steel used by the rebar cage (1) (by weight) is 15% less than that used by the prior-art rebar cage I.

TABLE 1

| Items | Prior-art rebar cage I | Rebar cage (1) |
|---|---|---|
| Ultimate load (tf) | 25.03 | 26.79 |
| Maximum displacement ratio (%) | 7.73 | 7.67 |
| Steel used (%) | 100% | 85% |

Figure 5:
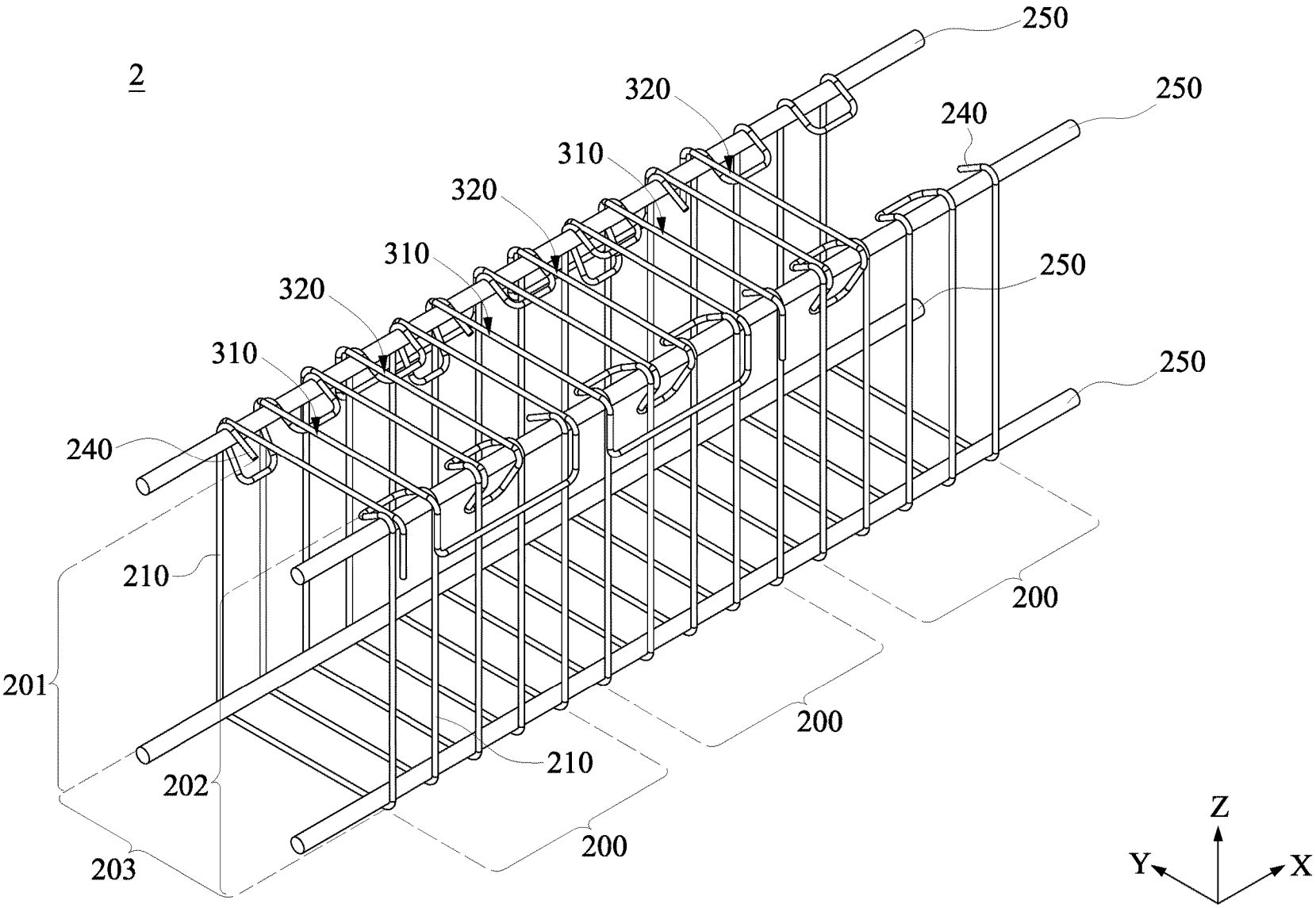
FIG. 5 is a perspective schematic view showing a rebar cage in accordance with another embodiment of the instant disclosure.

FIG. 5 shows a rebar cage (2) in accordance with another embodiment of the instant disclosure. The rebar cage (2) comprises a plurality of continuous stirrups (200) in series, a plurality of longitudinal tie bars (250), a plurality of first cap structures (310) and a plurality of second cap structures (320). In FIG. 5, there are three continuous stirrups (200) in series and each of them has one first cap structure (310) and one second cap structure (320) mounted on its top. Some other embodiments of the instant disclosure have a different number of continuous stirrups (200) and cap structures (310, 320) depending on the design of the beam having the rebar cage (2).

Please refer to FIGS. 5-13. The continuous stirrup (200) is defined as a first lateral section (201), a second lateral section (202) and a middle section (203) located between the first lateral section (201) and the second lateral section (202), wherein the first lateral section (201) and the second lateral section (202) are located at opposing sides of the middle section (203), generally parallel to each other, and generally perpendicular to the middle section (203). The continuous stirrup (200) comprises a plurality of first portions (210), a plurality of first positioning portions (260), a plurality of second positioning portions (270), a plurality of second portions (220), and a plurality of third portions (230). The plurality of first portions (210) are disposed along a Z-axis direction and located in the first lateral section (201) and the second lateral section (202) and are generally parallel to one another. The plurality of first positioning portions (260) are bent from the top ends of the plurality of first portions (210) located in the first lateral section (201) toward an inner side of the rebar cage (2). The plurality of second positioning portions (270) are bent from the top ends of the plurality of first portions (210) located in the second lateral section (202) toward the inner side of the rebar cage (2). The plurality of second portions (220) are disposed along an X-axis direction and connect two adjacent first positioning portions (260) or two adjacent second positioning portions (270). The plurality of third portions (230) are disposed along a Y-axis direction and located in the middle section (203). Each of the plurality of third portions (230) connects bottom ends of two opposing first portions (210). The plurality of longitudinal tie bars (250) extend along the X-axis direction and are connected to the plurality of first positioning portions (260) and the plurality of second positioning portions (270).

Figure 6:
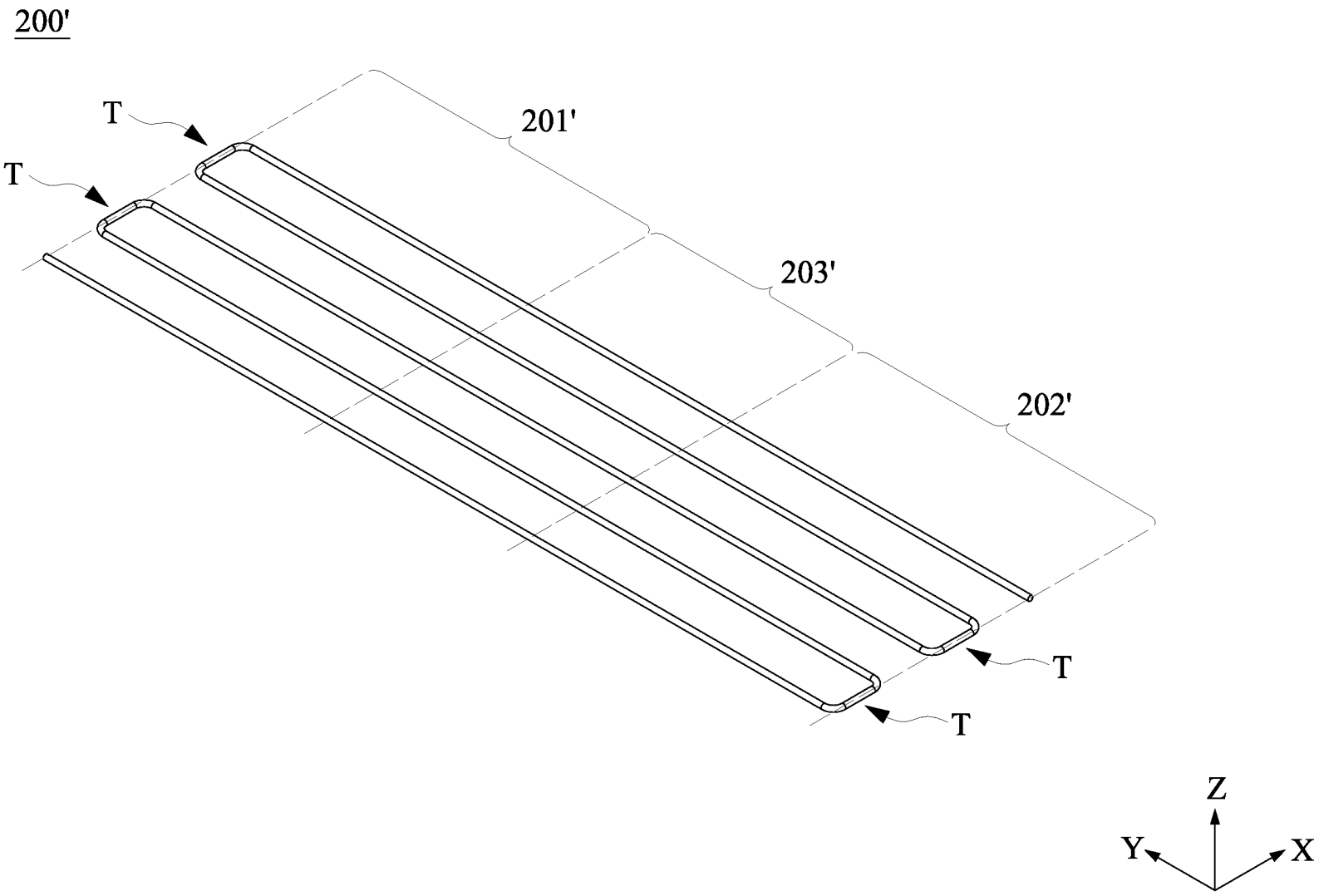
FIG. 6 is a perspective schematic view showing a continuous stirrup for making a rebar cage in accordance with the another embodiment of the instant disclosure.
Figure 7:
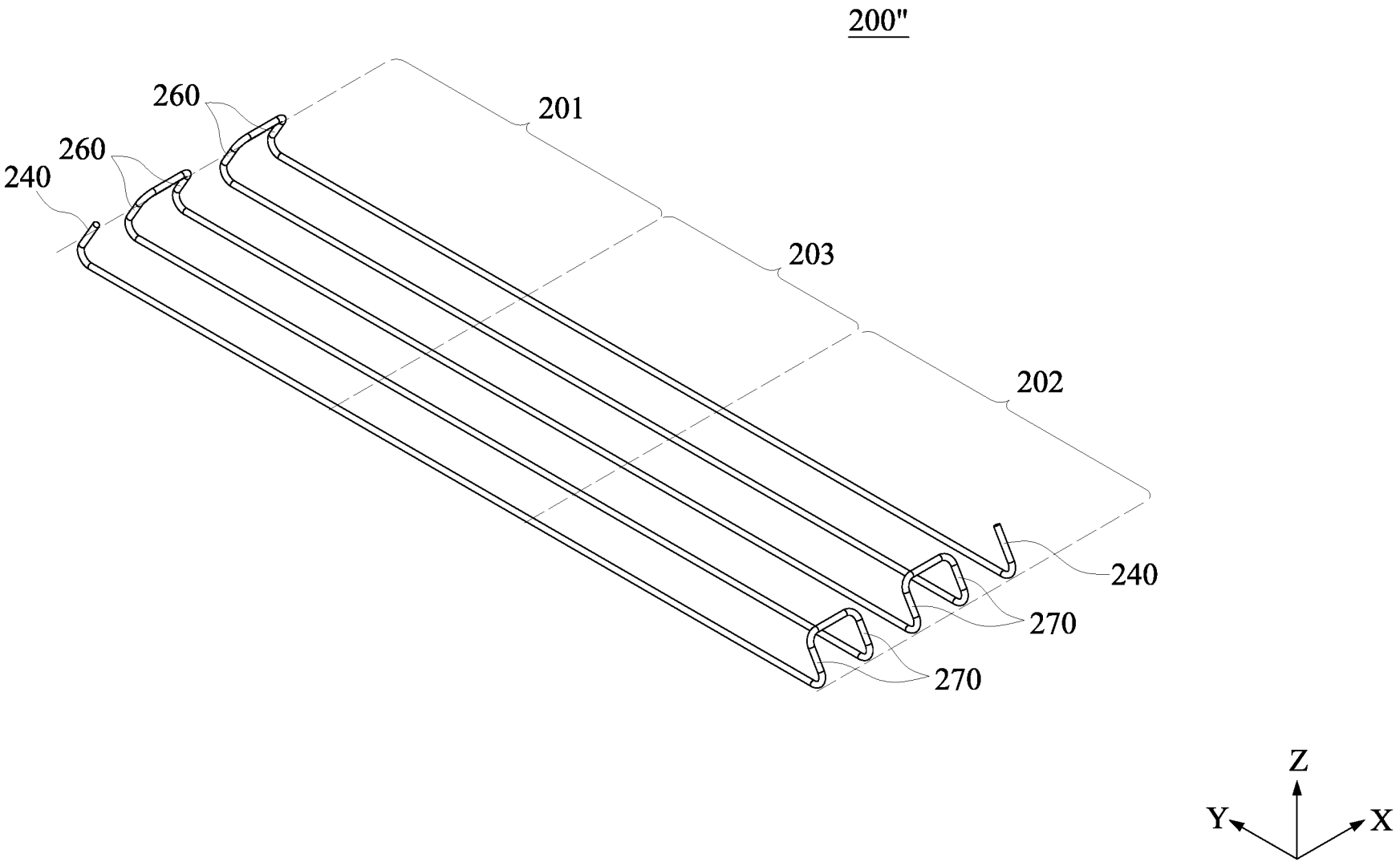
FIG. 7 is a perspective schematic view showing the continuous stirrup after being preliminary bent for making a rebar cage in accordance with the another embodiment of the instant disclosure.
Figure 8:
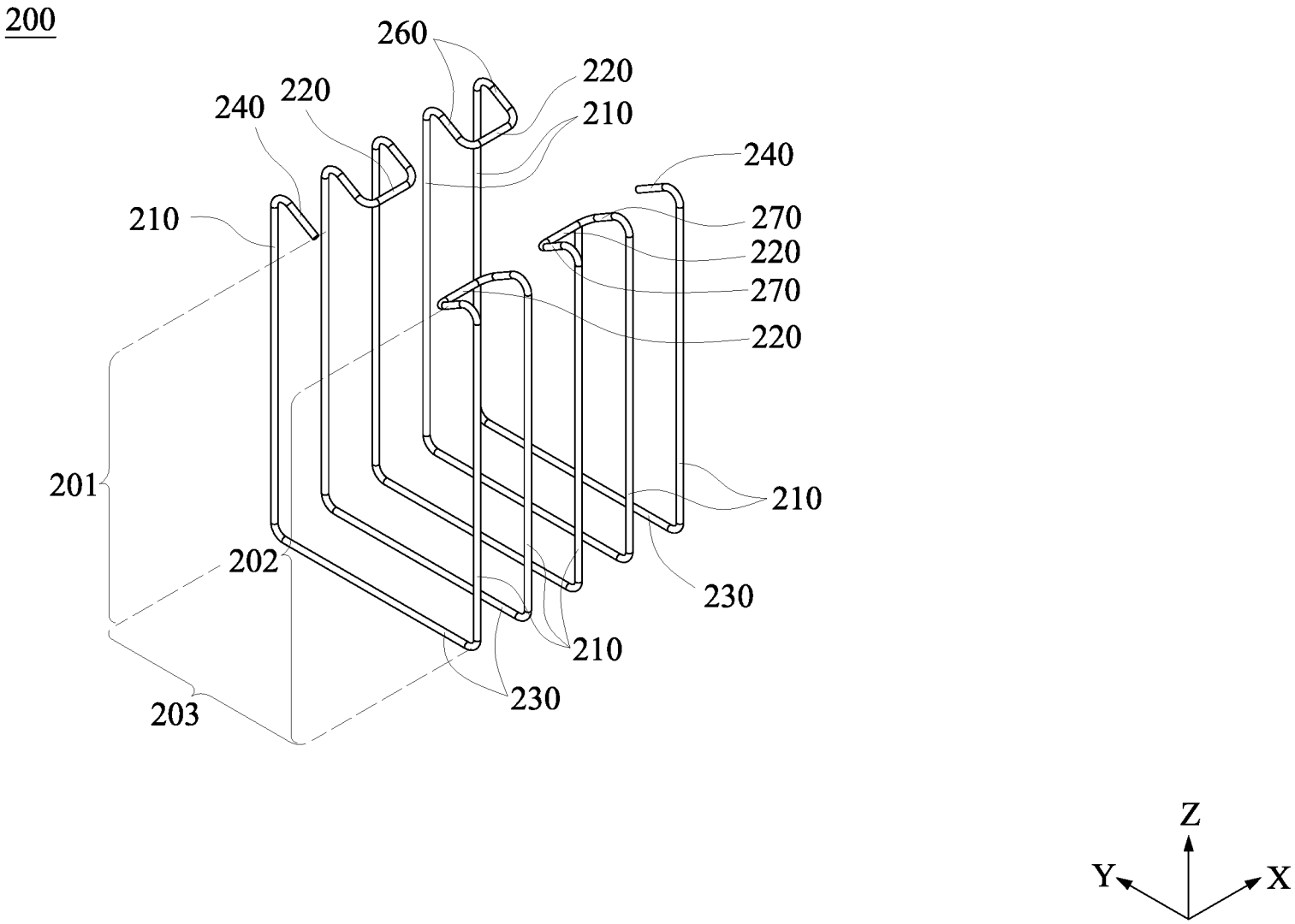
FIG. 8 is a perspective schematic view showing the continuous stirrup after being further bent for making a rebar cage in accordance with the another embodiment of the instant disclosure.

In some embodiments, the process of making the continuous stirrup (200) shown in FIG. 8 for the rebar cage (2) in FIG. 5 includes the following steps: (A) bending a straight rebar to form a planar structure 200' having alternating rectangular turns (T) as shown in FIG. 6 wherein the first lateral section (201'), the second lateral section (202'), and the third lateral section (203') are in the same plane; (B) bending the planar structure 200' to form the intermediate structure (200") having the plurality of first positioning portions (260), the plurality of second positioning portions (270) and hooks (240) as shown in FIG. 7; (C) securing at least a part of the first lateral section (201) and using an elongated device (not shown) to press against the second lateral section (202) and the third lateral section (203) toward the secured first lateral section (201); (D) securing at least a part of the second lateral section (202) and using the elongated device to press against the first lateral section (201) and the third lateral section (203) toward the secured second lateral section (202) so as to form the continuous stirrup (200) as shown in FIG. 8 wherein the first lateral section (201) and the second lateral section (202) are at opposing sides of the third lateral section (203), are generally parallel to each other, and are perpendicular to the third lateral section (203).

In the embodiment shown in FIGS. 5 and 11-13, the plurality of second portions (220) are alternatively disposed along the X-axis direction (see FIG. 11) so that the plurality of second portions (220) are not substantively overlapping in the Y-axis direction. However, in alternative embodiments, the plurality of second portions (120) substantively overlap in the Y-axis direction.

Please refer to FIGS. 5 and 11-13. Each of the two free ends of the continuous stirrup (200) comprises a hook (240) and the hooks (240) are bent toward the inner side of the rebar cage (2). In addition, one of the two hooks (140) is located in the first lateral section (201) and the other is located in the second lateral section (202). In alternative embodiments, the two hooks (240) are both located in the first lateral section (201) or are both located in the second lateral section (202). The hooks (240) are configured to prevent workers from being wounded. In other embodiments, the two free ends of the continuous stirrup (100) do not have such hooks and the two first portions (210) having the two free ends are shorter than the other first portions (210) so that the free ends, which may be sharp, would not be easily touched by workers.

As shown in FIGS. 5 and 11-13, there are four longitudinal tie bars (250) that extend along the X-axis direction of which two longitudinal tie bars (250) are opposingly disposed near the bottom of the rebar cage (2) and are respectively connected to the joints of the plurality of first portions (210) and the plurality of third portions (230) and the other two longitudinal tie bars (250) are opposingly disposed near the top of the rebar cage (2) and are respectively connected to the plurality of first positioning portions (260) in the first lateral section (201) and the plurality of second positioning portions (270) in the second lateral section (202). Furthermore, the joints of the plurality of first positioning portions (260) and the plurality of second portions (220) or the joints of the plurality of second positioning portions (270) and the plurality of second portions (220) are rounded to prevent workers from being wounded.

Figure 10:
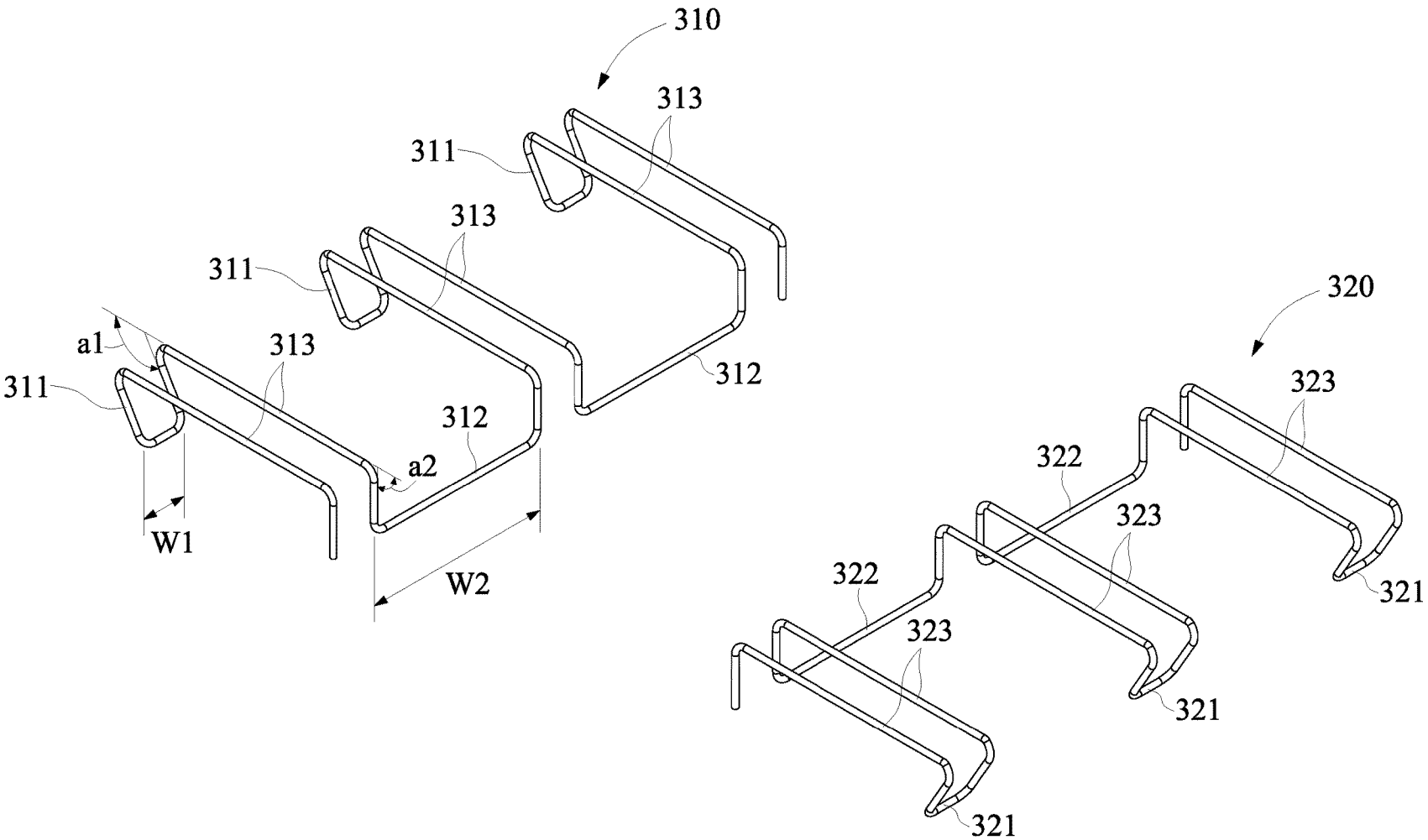
FIG. 10 is a schematic view showing the cap structures of a rebar cage in accordance with the another embodiment of the instant disclosure.

Please refer to FIG. 5. The first plurality of cap structures (310) and the second plurality of cap structures (320) are configured to sit astride the tops of the plurality of first portions (210) in the first lateral section (201) and the second lateral section (202). As shown in FIG. 10, the first plurality of cap structures (310) and the second plurality of cap structures (320) have the same structures. The orientations of the first plurality of cap structures (310) and the second plurality of cap structures (320) when assembled to the rebar cage (2) are as shown in FIG. 10. Each of the plurality of cap structures (310, 320) comprises: a plurality of bridging structures (313, 323), which are generally parallel to one another, a plurality of first fastening portions (311, 321) extending from one end of the plurality of bridging structures (313, 323), and a plurality of second fastening portions (312, 322) extending from the other end of the plurality of bridging structures (313, 323), wherein the plurality of first fastening portions (311, 321) and the plurality of second fastening portions (312, 322) are alternatively disposed along the lengthwise direction of the plurality of cap structures (310, 320).

In addition, each of the first fastening portions (311, 321) is narrower than each of the second fastening portions (312, 322). Please refer to FIG. 10. The first fastening portion (311, 321) is generally U-shaped and has a first width (W1) and the second fastening portion (312, 322) is also generally U-shaped and has a second width (W2) wherein the first width (W1) is smaller than the second width (W2). The first fastening portion (311, 321) and the second fastening portion (312, 322) are alternatively disposed along the lengthwise direction and at opposing sides of the first cap structure (310) and the second cap structure (320). In some embodiments, each of the first plurality of cap structures (310) and the second plurality of cap structures (320) has three first fastening portions (311, 321) and two second fastening portions (312, 322). In some other embodiments, the cap structures (310, 320) have a different number of the first fastening portions (311, 321) and the second fastening portions (312, 322).

As shown in FIG. 10, each of the plurality of first fastening portions (311, 321) forms a first angle (a1) with respect to the bridging structure (313, 323) and each of the plurality of second fastening portions (312, 322) forms a second angle (a2) with respect to the bridging structure (313, 323), and the first angle (a1) is larger than the second angle (a2). In some embodiments of the instant disclosure, the first angle (a1) ranges from 130 to 160 degrees and the second angle (a2) ranges from 75 to 95 degrees.

Figure 9:
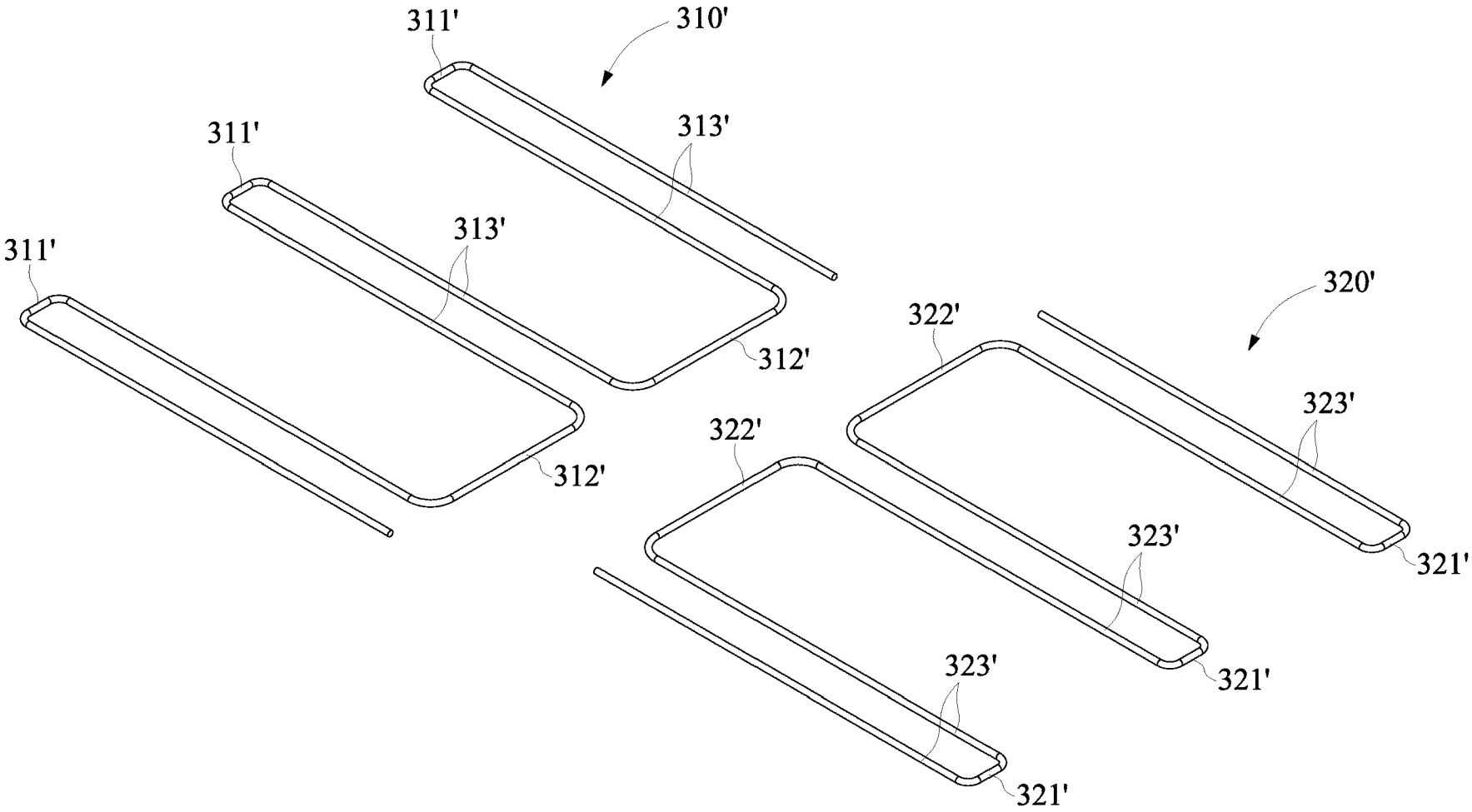
FIG. 9 is a schematic view showing continuous stirrups for making the cap structures of a rebar cage in accordance with the another embodiment of the instant disclosure.

In some embodiments of the present disclosure, each of the cap structures (310, 320) is formed from a single continuous stirrup. For example, the process of making the cap structures (310, 320) shown in FIG. 10 for the rebar cage (2) in FIG. 5 includes the following steps: (A) bending a straight rebar to form a planar structure (310', 320') having alternating rectangular turns as shown in FIG. 9 wherein the plurality of first fastening portions (311', 321'), the plurality of second fastening portions (312', 322'), and the plurality of bridging structures (313', 323') are in the same plane; (B) securing at least a part of the plurality of bridging structures (313, 323) and using an elongated device (not shown) to press against one free end of the planar structure (310', 320') so that it is bent downward to form the plurality of first fastening portions (311, 321); and (C) securing at least a part of the plurality of bridging structures (313', 323') and using the elongated device to press against the opposing free end of the planar structure (310', 320') so that it is bent downward to form the plurality of second fastening portions (312, 322).

Figure 11:
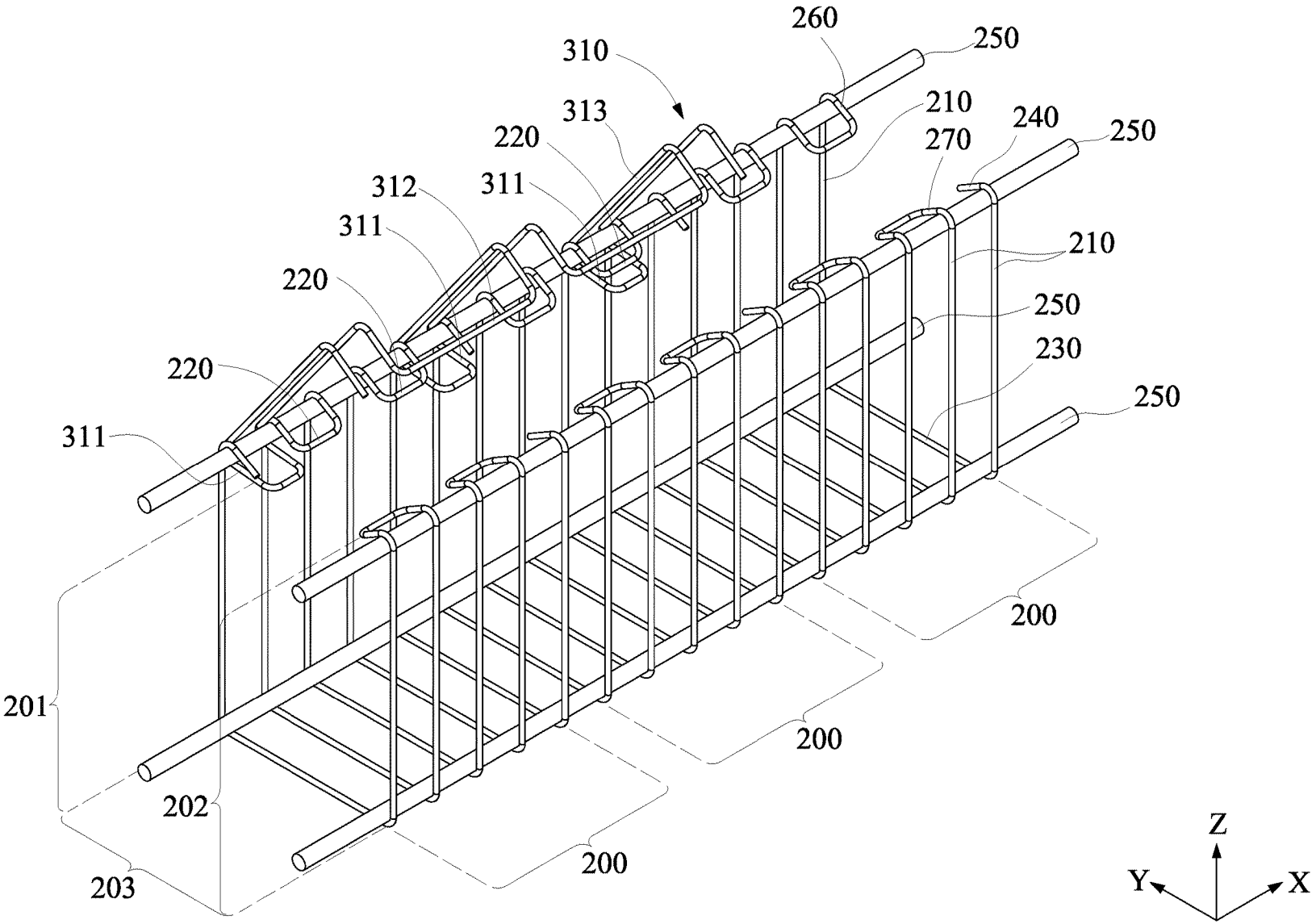
FIG. 11 is a schematic view 1 showing the assembly of the cap structures and the continuous stirrups in accordance with the another embodiment of the instant disclosure.
Figure 12:
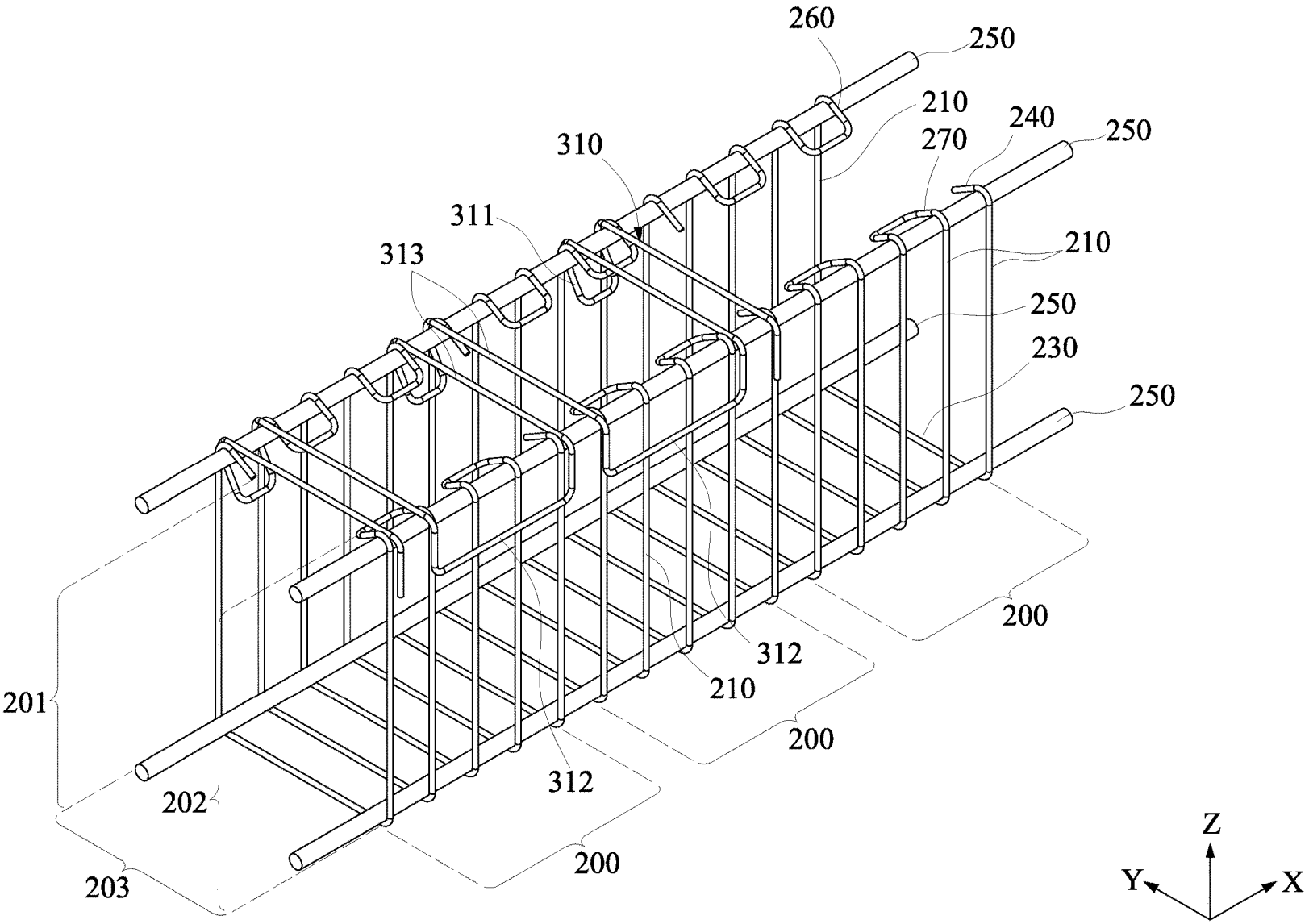
FIG. 12 is a schematic view 2 showing the assembly of the cap structures and the continuous stirrups in accordance with the another embodiment of the instant disclosure.
Figure 13:
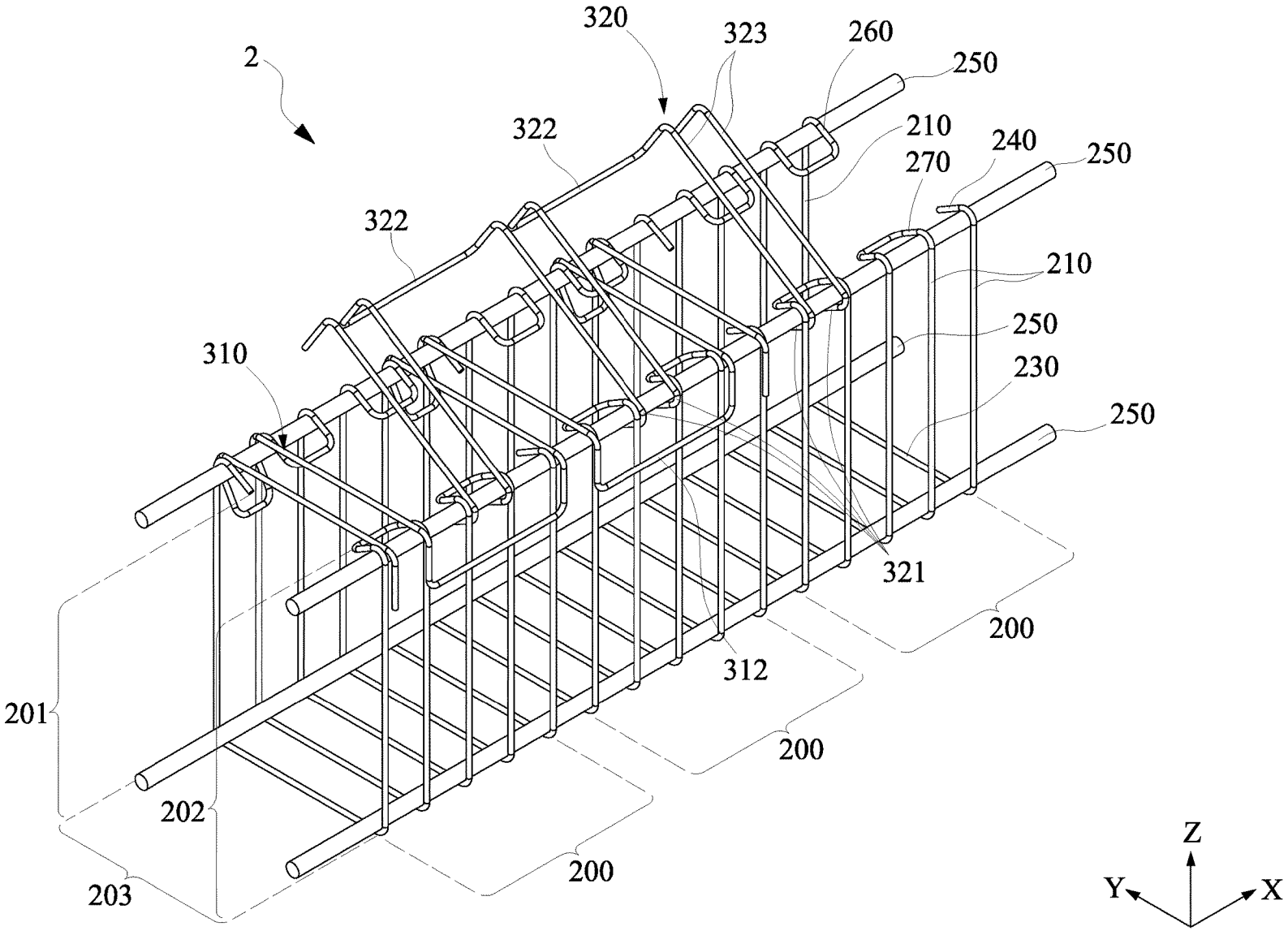
FIG. 13 is a schematic view 3 showing the assembly of the cap structures and the continuous stirrups in accordance with said another embodiment of the instant disclosure.

Please refer to FIGS. 11-13 showing the process of assembling the first and second cap structures (310, 320) shown in FIG. 10 with the continuous stirrups (200) shown in FIG. 8 to form the rebar cage (2) shown in FIG. 5 in accordance with one embodiment of the present disclosure. As shown in FIG. 11, three continuous stirrups (200) are placed in series and the predetermined distance between the adjacent continuous stirrups (200) is substantively the same as that between two first portions (210) of the continuous stirrups (200). In some embodiments, the number of the continuous stirrups (200) is more or less than three depending on the design of the beam containing these continuous stirrups (200).

The next steps include providing four longitudinal tie bars (250), disposing two of the longitudinal tie bars (250) near the bottom of the rebar cage (2) and respectively connecting these two longitudinal tie bars (250) to the joints of the plurality of first portions (210) and the plurality of third portions (230), and disposing the other two longitudinal tie bars (250) near the top of the rebar cage (2) and respectively connecting said the other two longitudinal tie bars (250) to the plurality of first positioning portions (260) in the first lateral section (201) and the plurality of second positioning portions (270) in the second lateral section (202).

The further next step is securing the first cap structures (310) to the tops of the first portions (210) of the continuous stirrups (200). Specifically, as shown in FIG. 11, each of the first fastening portions (311) of the first cap structures (310) is engaged with the longitudinal tie bar (250) in the first lateral section (201). Such first fastening portions (311) is at the same time disposed between two adjacent first portions (210) of the continuous stirrups (200) in the first lateral section (201), and overlapped with a second portion (220) of the continuous stirrups (200) in the first lateral section (201) in the Y-axis direction. Then, with reference to FIG. 12, each of the second fastening portions (312) of the first cap structures (310) is engaged with the longitudinal tie bar (250) in the second lateral section (202), and two sides of the second fastening portions (312) are disposed near the outer sides of two adjacent first portions (210) of the continuous stirrups (200).

The next step is securing the second cap structures (320) to the tops of the first portions (210) of the continuous stirrups (200). Specifically, as shown in FIG. 13, each of the first fastening portions (321) of the second cap structures (320) is engaged with the longitudinal tie bar (250) in the second lateral section (202). Such first fastening portion (321) is at the same time disposed between two adjacent first portions (210) of the continuous stirrups (200) in the second lateral section (202), and overlapped with a second portion (220) of the continuous stirrups (200) in the second lateral section (202) in the Y-axis direction. As shown in FIG. 13, the first fastening portions (321) of the second cap structures (320) are placed within the second fastening portions (312) of the first cap structures (310). The second fastening portions (322) of the second cap structures (320) are engaged with the longitudinal tie bar (250) in the first lateral section (201), and two sides of the second fastening portions (322) are disposed near the outer sides of two adjacent first portions (210) of the continuous stirrups (200) in the first lateral section (201).

Please refer to FIG. 13. The first cap structure (310) and the second cap structure (320) are interlaced on the top of the rebar cage (2) and do not interfere with each other. The plurality of first fastening portions (311) of the first cap structure (310) and the plurality of first fastening portions (321) of the first cap structure (320) are at opposite sides of the rebar cage (2) in a Y-axis direction, and the plurality of second fastening portions (312) of the first cap structure (310) and the plurality of second fastening portions (322) of the second cap structure (320) are at opposite sides of the rebar cage in the Y-axis direction.

Table 2 below shows the relevant test results based on the rebar cage (2) and a prior art rebar cage II, which is similar to the prior-art rebar cage as described in the background section of this application. The prior-art rebar cage II comprises a number of U-shaped stirrups welded or tied to several longitudinal rebars and the tops of the U-shaped stirrups are welded or tied to a wire mesh.

According to Table 2, the rebar cage (2) can bear a maximum load of 156 kN, which is around 11% greater than the maximum load of 141 kN that can be borne by the prior-art rebar cage II. The yield load for the rebar cage (2) is 142.9 kN, which is around 11% greater than the maximum load of 128.3 kN that can be borne by the prior-art rebar cage II. The rebar cage (2) under the load has a yield displacement ratio of 0.44%, which is around 10% less than the yield displacement ratio of 0.49% of the prior-art rebar cage II. The rebar cage (2) under the load has the maximum displacement ratio of 4.57%, which is around 4% less than the maximum displacement ration of 4.4% of the prior-art rebar cage II. In addition, the steel (by weight) used by the rebar cage (2) is 13% less than that used by the prior-art rebar cage II.

TABLE 2

| Item | Prior-art rebar cage II | Rebar cage (2) |
|---|---|---|
| Yield displacement ratio (%) | 0.49 | 0.44 |
| Yield load (kN) | 128.3 | 142.9 |
| Maximum load (kN) | 141 | 156 |
| Maximum displacement ratio (%) | 4.4 | 4.57 |
| Steel used (%) | 100% | 87% |

The above embodiments merely describe the principle and effects of the present disclosure, instead of limiting the present disclosure. Therefore, persons skilled in the art can make modifications to and variations of the above embodiments without departing from the spirit of the present disclosure. The scope of the present disclosure should be construed as that defined by the appended claims.

What is claimed is:

1. A rebar cage comprising:

a continuous stirrup defined as a first lateral section, a second lateral section and a middle section located between the first lateral section and the second lateral section, wherein the first lateral section and the second lateral section are located at opposing sides of the middle section, generally parallel to each other, and generally perpendicular to the middle section, the continuous stirrup comprising:

a plurality of first portions disposed along a Z-axis direction and located in the first lateral section and the second lateral section, the plurality of first portions being generally parallel to one another;

a plurality of first positioning portions bent from the top ends of the plurality of first portions located in the first lateral section toward an inner side of the rebar cage;

a plurality of second positioning portions bent from the top ends of the plurality of first portions located in the second lateral section toward the inner side of the rebar cage;

a plurality of second portions disposed along an X-axis direction and connecting tops of two adjacent first positioning portions or two adjacent second positioning portions; and a plurality of third portions disposed along a Y-axis direction and located in the middle section, each of the plurality of third portions connecting bottoms of two opposing first portions;

a plurality of longitudinal tie bars extending along the X-axis direction and being connected to the plurality of first portions, the plurality of first positioning portions and/or the plurality of second positioning portions; and a plurality of cap structures configured to sit astride the tops of the plurality of first portions in the first lateral section and the second lateral section;

wherein two of the plurality of longitudinal tie bars are respectively connected to the plurality of first positioning portions and the plurality of second positioning portions;

wherein each of the plurality of cap structures comprises:

a plurality of bridging structures, which are generally parallel to one another;

a plurality of first fastening portions extending from one end of the plurality of bridging structures; and a plurality of second fastening portions extending from the other end of the plurality of bridging structures;

wherein the plurality of first fastening portions and the plurality of second fastening portions are alternatively disposed along the lengthwise direction of the plurality of cap structures.

2. The rebar cage according to claim 1, wherein each of the first fastening portions is narrower than each of the second fastening portions.

3. The rebar cage according to claim 2, wherein each of the plurality of first fastening portions forms a first angle with respect to the bridging structure and each of the plurality of second fastening portions forms a second angle with respect to the bridging structure and wherein the first angle is larger than the second angle.

4. The rebar cage according to claim 3, wherein the first angle ranges from 130 to 160 degrees and the second angle ranges from 75 to 95 degrees.

5. The rebar cage according to claim 3, wherein each of the cap structures is formed from a single continuous stirrup.

6. The rebar cage according to claim 1, wherein the plurality of cap structures comprises a first cap structure and a second cap structure, wherein the first cap structure and the second cap structure are interlaced on the top of the rebar cage and do not interfere with each other.

7. The rebar cage according to claim 6, wherein the plurality of first fastening portions of the first cap structure and the plurality of first fastening portions of the second cap structure are at opposite sides of the rebar cage in a Y-axis direction, and the plurality of second fastening portions of the first cap structure and the plurality of second fastening portions of the second cap structure are at opposite sides of the rebar cage in the Y-axis direction.

* * * * *